US005687875A

United States Patent [19]

Watts et al.

[11] Patent Number: 5,687,875

[45] Date of Patent: Nov. 18, 1997

[54] DISPENSER FOR WIPES

[75] Inventors: Hugo Paul Watts, Mold; Evelyn Margaret Murphy, Beaconsifeld, both of Great Britain

[73] Assignee: Kimberly-Clark Worldwide, Inc., Neenan, Wis.

[21] Appl. No.: 416,886

[22] PCT Filed: Oct. 8, 1993

[86] PCT No.: PCT/GB93/02089

§ 371 Date: Jan. 3, 1996

§ 102(e) Date: Jan. 3, 1996

[87] PCT Pub. No.: WO94/08500

PCT Pub. Date: Apr. 28, 1994

[51] Int. Cl.[6] ..... A47K 10/24

[52] U.S. Cl. ..... 221/45; 221/102

[58] Field of Search ..... 221/33, 34, 102, 221/48, 45, 46, 49, 63

[56] References Cited

U.S. PATENT DOCUMENTS

| | | | |
|---|---|---|---|
| D. 277,169 | 1/1985 | Ito et al. | D9/418 |
| D. 277,553 | 2/1985 | Ito et al. | D9/416 |
| 1,783,414 | 12/1930 | Daniels | 206/57 |
| 1,988,939 | 1/1935 | Craig | 206/57 |
| 2,182,615 | 12/1939 | Johnson | 206/16 |
| 2,566,016 | 8/1951 | Cochran | 229/15 |
| 2,592,255 | 4/1952 | Drees | 221/34 |
| 3,072,245 | 1/1963 | Faltin | 206/19.5 |
| 3,141,569 | 7/1964 | Hanson | 221/34 |
| 3,221,928 | 12/1965 | Horn | 221/34 |
| 3,245,580 | 4/1966 | Campanella | 221/34 |
| 3,372,837 | 3/1968 | Neumann | 221/102 |
| 3,684,158 | 8/1972 | Harris | 221/33 |
| 3,747,802 | 7/1973 | Uroshevich | 221/63 |
| 4,412,619 | 11/1983 | Van Laer | 206/611 |
| 4,469,243 | 9/1984 | Ito et al. | 221/34 |
| 4,478,354 | 10/1984 | Notheis | 221/34 |
| 4,546,914 | 10/1985 | Roccaforte | 229/52 B |
| 4,919,302 | 4/1990 | McPherson | 221/34 |
| 4,993,589 | 2/1991 | McLaughlin | 221/33 |

FOREIGN PATENT DOCUMENTS

| | | | |
|---|---|---|---|
| 870976 | 5/1971 | Canada . | |
| D. 54389 | 3/1973 | Canada . | |
| D. 54948 | 6/1987 | Canada . | |
| 0419063A3 | 3/1991 | European Pat. Off. . | |
| 2128162 | 10/1972 | France . | |
| 8809423 | 11/1988 | Germany . | |
| 48911 | 11/1989 | Germany | 221/102 |
| 9102718 | 5/1991 | Germany . | |
| 402604 | 12/1933 | United Kingdom . | |
| 733723 | 7/1955 | United Kingdom . | |
| 826578 | 1/1960 | United Kingdom . | |
| 1058131 | 2/1967 | United Kingdom . | |
| 1180434 | 2/1970 | United Kingdom . | |
| 2231323 | 5/1989 | United Kingdom . | |

*Primary Examiner*—Kenneth Noland
*Attorney, Agent, or Firm*—Karl V. Sidor

[57] ABSTRACT

Dispensers in accordance with the invention are extremely adaptable. They may be used either as a portable dispenser for wipes, or mounted to a wall or fixed surface. Two similar containers may be joined together to form a dispenser in order to carry twice as many wipes or to dispense two different types of wipes thereby eliminating the need to carry two containers, one for each product. Alternatively, one container may be used to dispense wipes and the other may be used as a receptacle for soiled or used wipes. The containers may be substantially identical.

12 Claims, 5 Drawing Sheets

DISPENSER FOR WIPES

This invention relates to a dispenser for disposable wipers made, for example, from paper or nonwoven material and like products.

Known dispensers for paper wipes and the like fall into two main types, according to whether a portable supply of wipes is required or whether the wipes are to be dispensed from a single fixed location.

Where a portable supply of wipes is required it is common to provide the wipes in a disposable box or package. Where wipes are provided in a disposable box the boxes or the like are not refillable and are therefore relatively wasteful and environmentally undesirable. Furthermore, once a wipe has been dispensed and used, the user is presented with the problem of how to dispose of the used, soiled wipe.

U.S. Pat. No. 2,566,016 discloses a container for dispensing dispensable tissues having a compartment for holding fresh tissues and a second compartment for receiving used tissues, the compartments being separable so as to fill or empty the compartments.

Where wipes are to be dispensed from a single fixed location, non-disposable dispensers are used which may be mounted to a wall or to a horizontal surface such as, for example, the underside of a work surface. Such dispensers generally contain more wipes than portable boxes or similar packages and they may be refilled, but they only provide a fixed source of wipes.

A dispenser for paper wipes and the like in accordance with the invention comprises a first container which is adapted to hold a stack of wipes, the first container having an aperture in one face providing an opening through which wipes may be dispensed and a second container for receiving used or soiled wipes, the second container having an aperture in one face providing an opening through which wipes may be passed, characterised in that a portion of each of the first and of the second containers being movable between a closed position and a released position in which the first container may be filled or emptied or in which the second container may be emptied, in that complementary connection means are provided on the first and second containers to enable the two containers to be releasably joined together and in that the separate containers are each adapted to contain wipes.

The two containers may be joined together to form a single dispenser unit for dispensing fresh wipes and for receiving used or soiled wipes.

Such a dispenser may be used either to provide a portable source of, and receptacle for, wipes, or it may be used as a fixed dispenser, by being mounted to a wall or fixed surface. In either case, the first container of the dispenser is refillable, and there is no wastage of packaging or disposable boxes.

The first and second containers may be substantially identical.

In order for the two containers to be releasably joined together, each container is provided with integral mating connection means. These may take the form of, for example, complementary velcro strips, magnets, press studs, studs/holes or lugs/channels.

The connection means may be asymmetrical but complementary about an axis along one side of each of the containers, and they may be integrally formed with the containers.

The dispenser may have a handle located above the apertured face of the first container, the handle being disposed so that access to the aperture is not obstructed by the handle. Such an arrangement renders the dispenser readily portable.

A handle may also be provided above the apertured face of the second container and disposed so that access to the aperture thereof is not obstructed by the handle. Preferably the handles are located such that the handles on the two containers are adjacent when the containers are releasably joined together.

With such an arrangement, when the containers are joined together, a single, larger handle is formed which enables the user to carry the dispenser more comfortably.

The second container, which is to be used as a receptacle for used or soiled wipes, may have a detachable liner. The liner may be water and solvent resistant, so as to improve containment of the soiled wipes and to make handling and removal of the wipes from the second container easier and cleaner.

Means may be provided to indicate the quantity of wipes present in the or each container. This may comprise a window formed of clear plastic, for example.

Embodiments of the invention will now be described by way of example only and with reference to the accompanying drawings, in which.

Figure 11:
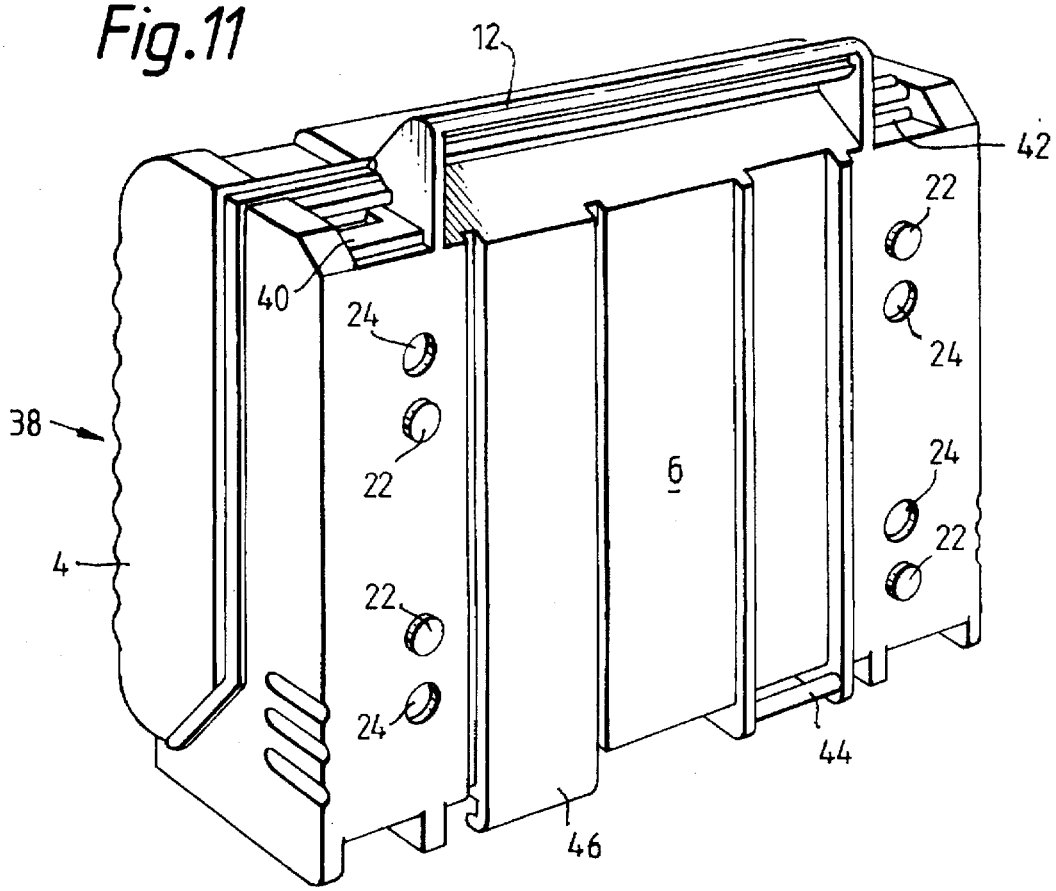
FIG. 11 is a perspective view from the rear of one side of a further container.
Figure 12:
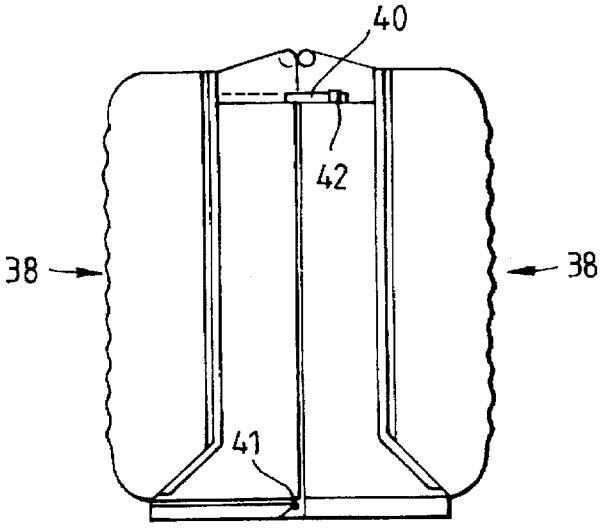
Figure 11A:
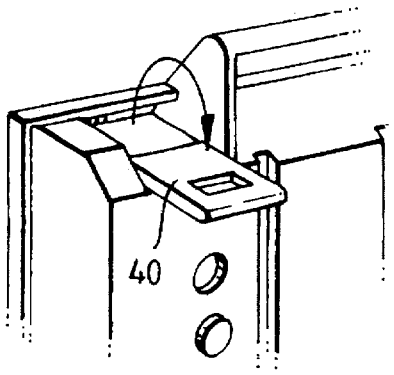

FIG. 11*a* is an enlarged view of a portion of the container of FIG. 11, and FIG. 12 is a sketch showing two of the containers of FIG. 11 connected together to form yet a further embodiment of a dispenser in accordance with the invention.

Referring to FIG. 12, the first container generally indicated at 52 is formed of rigid plastic material in two parts 54, 56 hingedly connected together by means of a hinge (not shown). Alternatively, the parts 54 and 56 may be a one piece moulding of such material that it can flex around the hinge point, so avoiding the necessity for a separate hinge.

As a third alternative, the parts may be releasably joined together by suitable releasable connectors (not shown).

Figure 3:
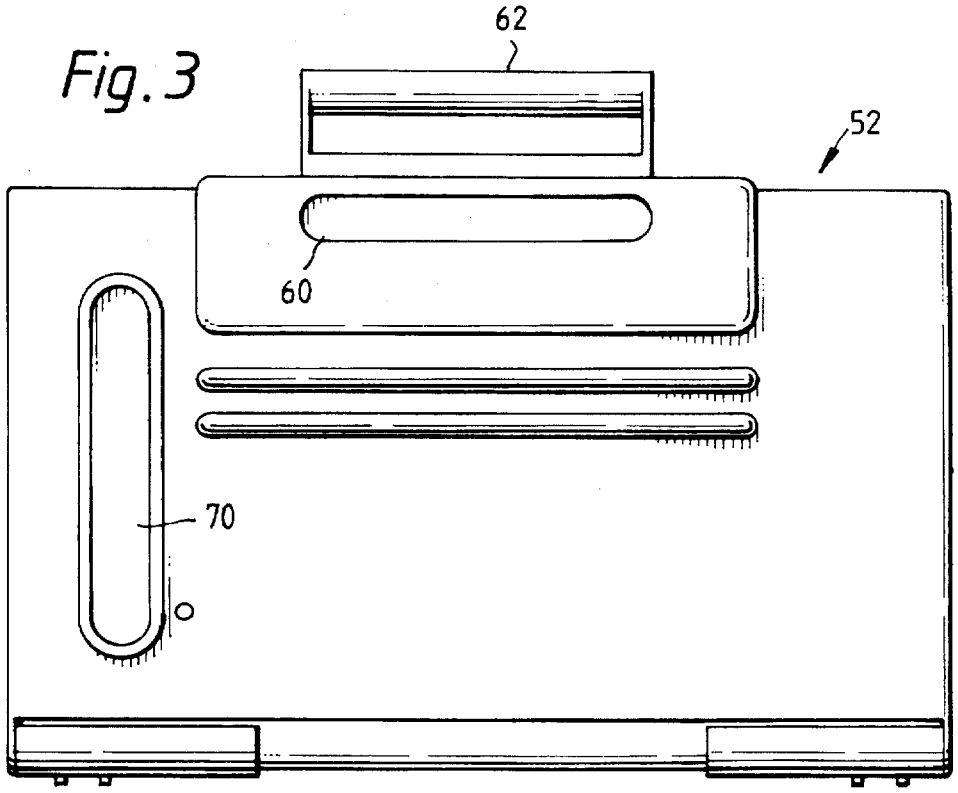
FIG. 3 is a view of the front of the container of FIG. 1.

In each case a dispensing aperture 60 (see FIG. 3) through which wipes or the like may be dispensed is formed in or adjacent to the top surface 58 of part 54. Alternatively, the top mating edges of the parts 54,56 may be out away on the top surface 58 or part 56 to form the dispensing aperture (not shown).

Figure 1:
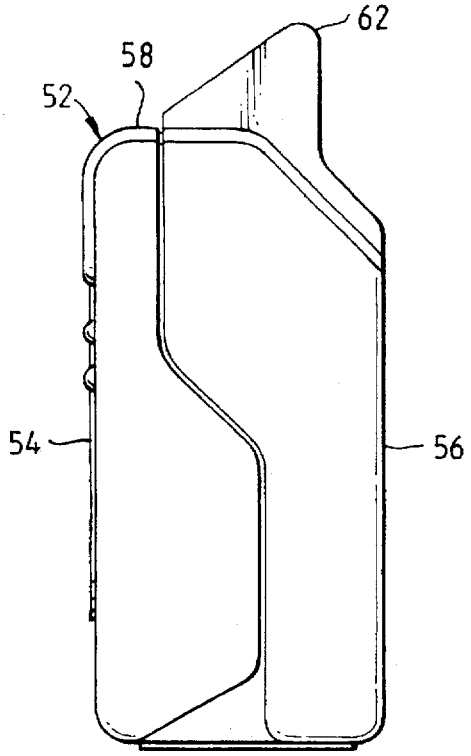
FIG. 1 is a side view of a first container.

When it is desired to refill the container 52 with a new stack of wipes, or to remove a stack of wipes therefrom and to replace them with a stack of a different type of wipes, part 54 is swung away from part 56 of the container 52 on hinges (not shown) or, as the case may be, part 54 is detached from part 56 and a new stack of wipes loaded into the container 52 and then part 54 is returned to the position shown in FIG. 1 so as to retain the stack of wipes (not shown) in the container 2.

A handle 62 is located on the top surface 58 of the first container 52, offset to one side thereof so as not to obstruct access to the dispensing aperture 60 and also for reasons to be described below.

A clear plastic window 70 is provided on the first face of part 54 of the first container 52 (see FIG. 3) so that a user can readily see how many wipes remain in the first container.

Figure 2:
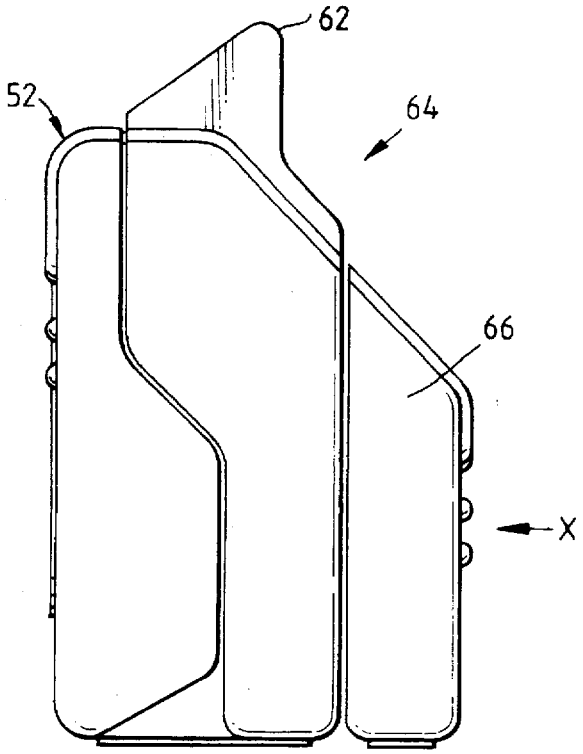
FIG. 2 is a side view of a first embodiment of a dispenser in accordance with the invention showing a second container connected to the container of FIG. 1.
Figure 5:
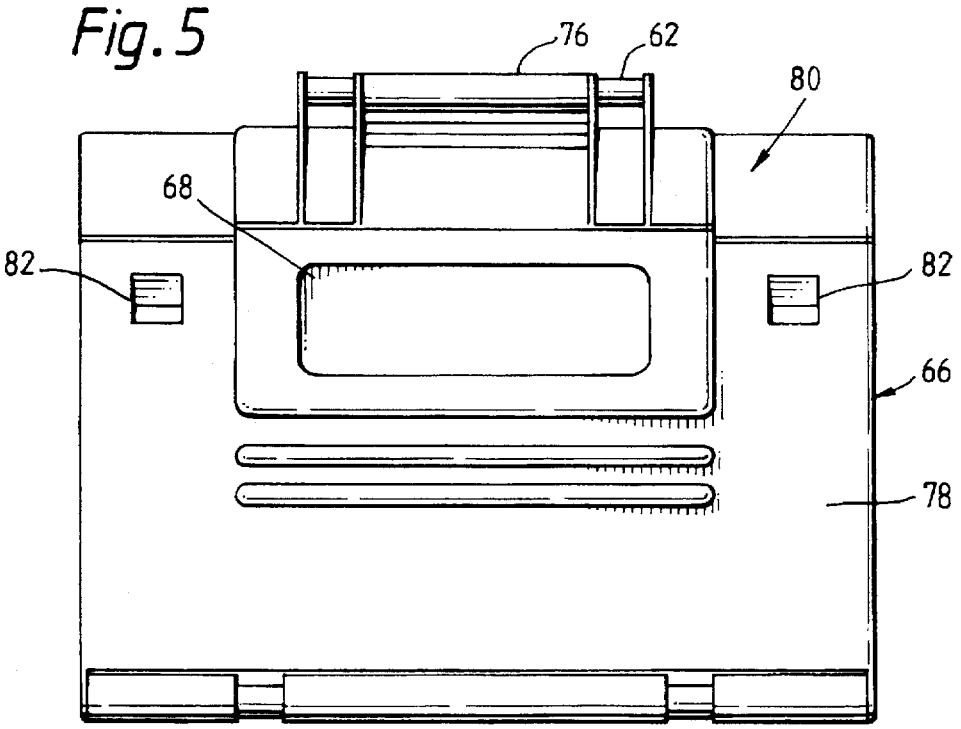

Referring now to FIG. 2, a dispenser 64 comprises a first container 52 releasably connected to a second container 66. The second container is provided with an aperture 68 (see FIG. 5) through which used or soiled wipes may be passed for storage within the second container 66 until these wipes may be permanently disposed of.

Figure 4:
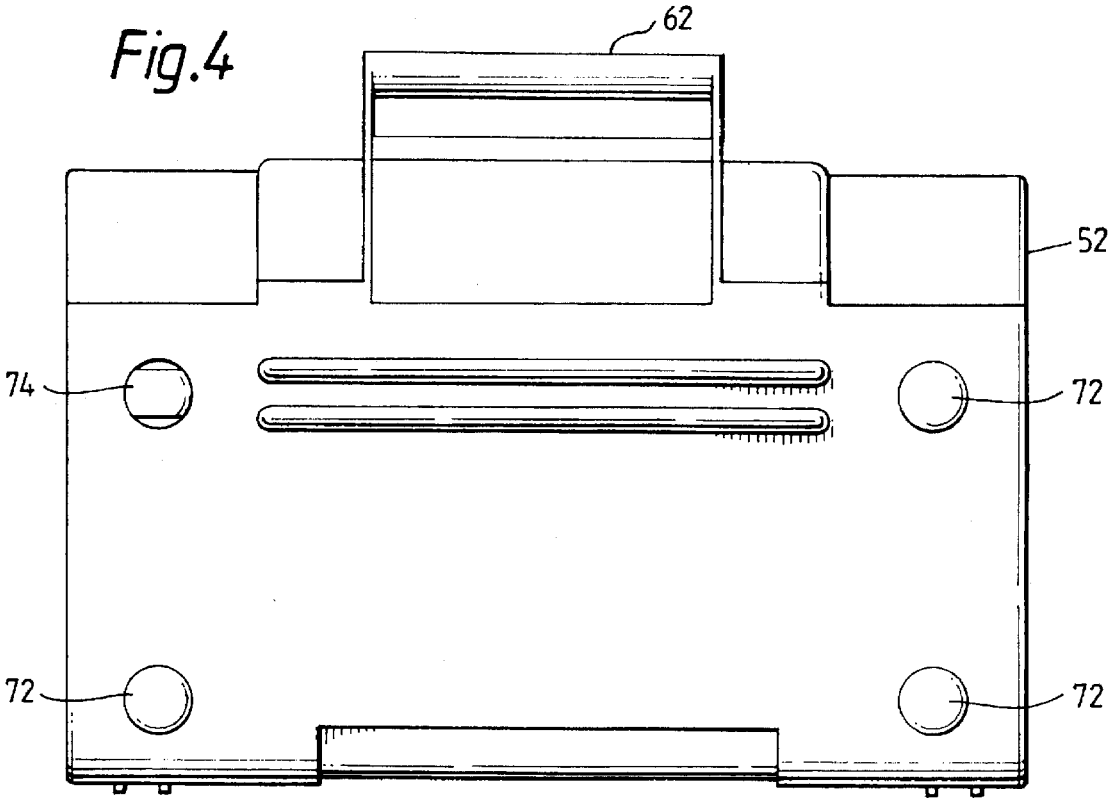
FIG. 4 is a view of the rear of the container of FIG. 1 illustrating one form of connection means and FIG. 5 is a view of the dispenser of FIG. 2 along arrow X.

The rear face of part 54 of the first container 52, as shown in FIG. 4, is provided with plugs 72 which are releasably engagable with complementary holes or sockets 74 (one is shown in FIG. 4) provided on the mating face (not shown) of the second container 66 so that the two containers 52,66 can be releasably connected together. Alternative connecting means (not shown) may be provided so that the two containers 52,56 can be releasably connected together.

The second container 66 is provided with a handle 76 (see FIG. 5) which is offset so as not to obstruct access to the aperture 68 and so that, when the two containers 52,66 are connected together, to form a dispenser 64, the offset of the handles 62,76 ensures that they are located substantially adjacent to one another to form a substantially simple larger handle which makes the dispenser 64 more comfortable to carry. The offset of the handles 62,76 is also arranged to take account of the different weights of the two containers 52,66 so that the dispenser 64 depends substantially squarely beneath the confined handles 62,76.

The second container 66 may contain a detachable liner (not shown) to facilitate the handling and disposal of the soiled wipes. The liner may be water and solvent resistant to improve containment of the soiled wipes.

The second container 66 is formed of rigid plastic in two parts 78,80 hingedly connected together by means of a hinge (not shown). Resilient tabs 82 are provided to latch the two parts 78,80 together in a snap fit but which can be pressed so as to unlatch the two parts 78,80 to allow the second container 66 to be opened so as to remove soiled wipes therefrom.

The dispenser 64 provides a portable supply of fresh wipes together with a portable receptacle for used or soiled wipes. Alternatively, the dispenser 64 may be provided with means (not shown) such as holes or 'knock-through' holes by which the dispenser 64 may be mounted to a wall or other fixed surface.

Figure 6:
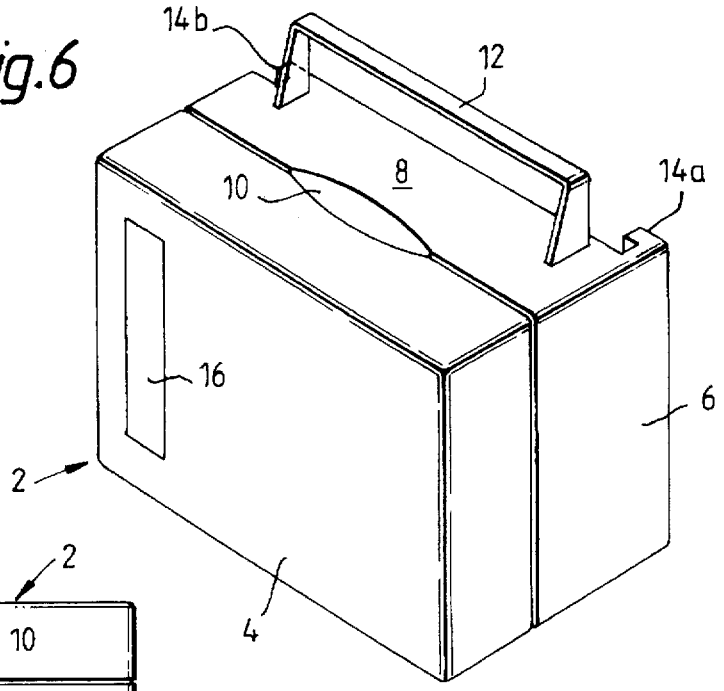
FIG. 6 is a perspective view of an alternative container.

Referring to FIG. 6, the container generally indicated at 2 is formed of rigid plastic material in two parts 4,6 hingedly connected together by means of a hinge (not shown). Alternatively, the parts 4 and 6 may be a one piece moulding of such material that it can flex around the hinge point, so avoiding the necessity for a separate hinge. As a third alternative, the parts may be releasably joined together by suitable releasable connectors (not shown).

In each case the top mating edges of the parts 4,6 are cut away on the top surface 8 of container 2 to form an aperture 10 through which wipes or the like may be dispensed.

Alternatively, the dispensing aperture may be wholly formed in the top surface of either part 4 or part 6 ( not shown ).

A handle 12 is located on the top surface 8 of the container 2, offset towards one side thereof so as not to obstruct access to the dispensing aperture 10 and also for reasons to be described below.

One part 6 of the container 2 is formed with a lug **14*a* running along the vertical edge of a side face and a complementary channel 14*b*** runs along the other vertical edge of that face to provide releasable connection means between two containers.

A clear plastic window 16 is provided on the other face so that a user can readily see how many wipes remain in the container.

When it is desired to refill the container 2 with a new stack of wipes, or to remove a stack of wipes therefrom and to replace them with a stack of a different type of wipe, part 4 is swung away from part 6 of the container 2 on hinges (not shown) or, as the case may be, part 4 is detached from part 6 and a new stack of wipes loaded into the container 2 and then part 4 is returned to the position shown in FIG. 6 so as to retain the stack of wipes (not shown) in the container 2.

Figure 7:
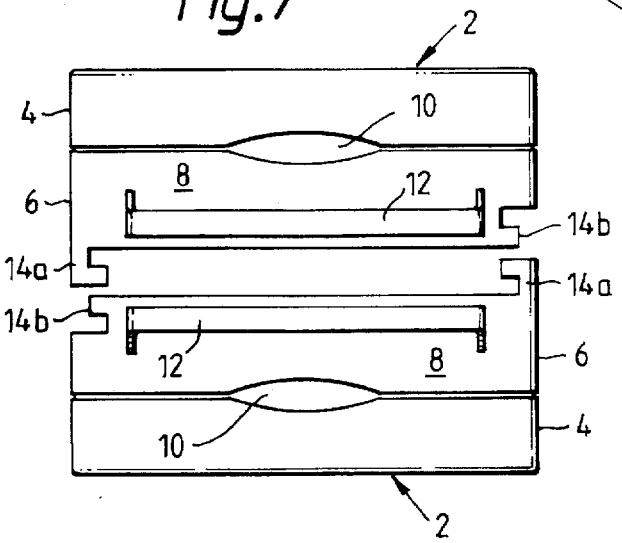
FIG. 7 is a plan view of two of the containers of FIG. 6 forming a second embodiment of a dispenser in accordance with the invention, showing the containers separated from each other and illustrating another form of connection means.

Turning now to FIG. 7, two of the containers 2 of FIG. 6 are shown from above located adjacent to each other but not joined together. To join the two containers 2 together to form a dispenser in accordance with the invention, one container is moved relative to the other so that the lug **14*a* on one container engages in slide 14*b* of the other container and lug 14*a* of said other container engages with slide 14*b* of the first container to form a single dispenser unit comprising two containers releasably joined together. When the two containers are joined together the offset of handles 12** ensures that they are located substantially adjacent to one another to form a substantially single, larger handle which is more comfortable for a user to carry.

When joined together in this way, the two containers forming the dispenser may be used to hold either the same type of wipes or each container 2 may hold different types of wipes.

Alternatively, one container 2 may contain wipes and the other container 2 may be left empty and used as a receptacle for used or soiled wipes. The container used as a receptacle for used or soiled wipes may contain a detachable or removable liner (not shown) to facilitate the handling and disposal of the soiled wipes, and the liner is suitably water and solvent resistant to improve containment of the soiled wipes.

The container 2 shown in FIG. 6 may be mounted to a wall or other fixed surface such as, for example, the underneath of a work surface, using a suitable mounting plate (not shown) having complementary lug **14*a* and channel 14*b*. In this way a container 2 may be mounted to a surface to dispense wipes either upwardly or downwardly or it may be mounted horizontally to the underside of the work surface or counter. The container may be releasably mounted to such a mounting bracket or it may be fixed more permanently using screws or bolts or the like (not shown). To enable permanent fixture the container may have ready made holes (not shown), or areas where the wall of the container 2** is sufficiently thin to allow suitable holes to be "knocked out".

Figure 8:
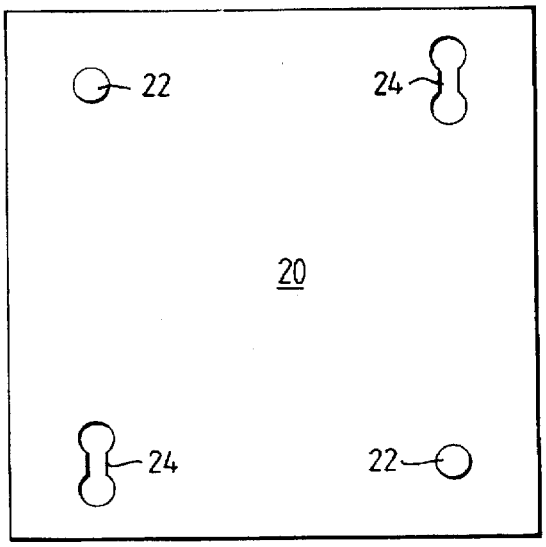
FIG. 8 is an elevation of an alternative connection means.
Figure 9A:
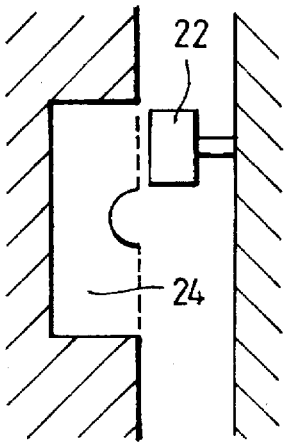
FIGS. 9A, 9B and 9C are cross-sectional views of two containers provided with the connection means of FIG. 8 and showing the sequence of steps to connect the containers together.
Figure 9B:
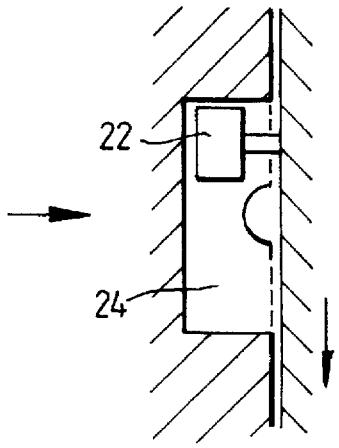
Figure 9C:
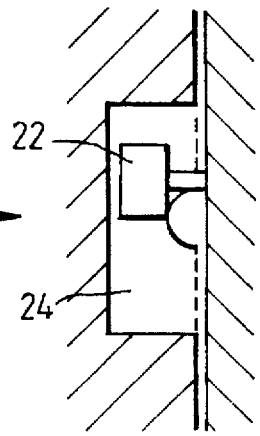

Referring now to FIGS. 8 and 9, mounting means are shown which may be used as an alternative to lug **14*a* and slide 14*b* of the embodiment shown in FIGS. 1 and 2. The mounting means comprises a plate 20 provided with projecting studs 22 and complementary slotted recesses 24 in the form of a dumbbell. Mounting plate 20 may be fixed or formed on one side of each container 2 or it may be mounted to a wall or fixed surface. Two such containers are then joined together to form a dispenser in accordance with the invention by pushing them together so that studs 22 enter complementary recesses 24 (see FIG. 9A, 9B) and then sliding one container 2 relative to the other so that the studs 22 are retained in recesses 24 (FIG. 9C). A dispenser 2 having such a mounting plate 20 may similarly be mounted to a wall or fixed surface to which a mounting plate 20** has been fixed by any suitable method.

Figure 10:
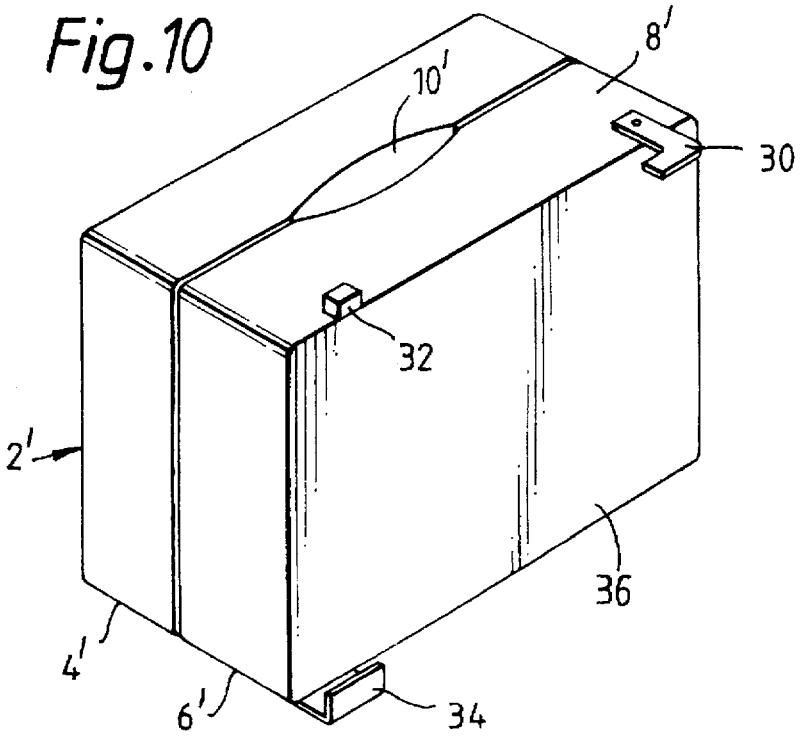
FIG. 10 is a perspective view of an alternative container forming part of a further embodiment of a dispenser in accordance with the invention.

Referring to FIG. 10, and alternative container 2' (for clarity, no handle is shown in FIG. 10) is formed of two parts and 4' and 6', and part 6' is provided with a pivoting hook 30 and a locating pin 32 on its top face. A bottom locating bracket 34 is provided on the bottom face and a bottom locating recess is provided in the area indicated generally by reference 36. Pivoting hook 30 and locating pin 32 and bottom locating brackets 34 and bottom locating recess 36 are complementary, so that two such containers 2' may be joined together back to back to form a dispenser in accordance with the invention.

Bottom locating bracket of 34 of one container 2' fits into the bottom locating recess 36 of the other container 2' and bottom locating bracket 34 of that container 2' fits into the bottom locating recess 36 of the first container 2'. The pivoting hooks 30 are then moved so as to engage locating pins 32.

When a container is to be used singly, hook 30 of container 2' may be pivoted so as to lie flat on the top surface 8' of the container 2' and bottom locating bracket 34 may be detached from container 2'. Alternatively, bottom locating bracket 34 may be slidably mounted to the bottom of container 2' so that, when the container 2' is to be used singly as a portable dispenser of wipes, bracket 34 may be slid so as to lie flush with the edge of container 2'.

FIGS. 11, 11A and 12 illustrate an alternative container 38 forming a yet further embodiment of the invention, having the attachment means illustrated in FIGS. 8 and 9.

A pivotable flap catch 40 (shown enlarged in FIG. 11A) is provided at one side of each container 38 and an upstanding mating peg 42 on the other side. Hence when two containers 38 are connected together, back to back, as shown in FIG. 7, the catch on each container 38 is pivoted over to engage the peg on the other so as to look the top of the containers 38 together.

Similarly, one side of the bottom back face of each container 38 is provided with a bar 44 on the other side with a complimentary hook 46. When the two containers 38 are to be locked together the hook member 46 of the two containers 38 are engaged over the mating bars 44 to lock the bottom of the containers together and to form a hinge enabling one container 38 to swing away from the other once the catches 40,42 have been opened.

We claim:

1. A dispenser for paper wipes and the like comprising:

a first container which is adapted to hold a stack of wipes, the first container having an aperture in one face providing an opening through which wipes may be dispensed and a handle located above the apertured face, the handle being disposed so that access to the aperture is not obstructed by the handle, and a second container for receiving used or soiled wipes, the second container having an aperture in one face providing an opening through which wipes may be passed and a handle located above the apertured face of the second container wherein the handles are located such that the handles on the two containers are adjacent when the containers are releasably joined together, wherein a portion of each of the first and of the second containers being movable between a closed position and a released position in which the first container may be filled or emptied or in which the second container may be emptied, and wherein complementary connection means are provided on the first and second containers to enable the two containers to be releasably joined together.

2. A dispenser as claimed in claim 1, wherein the first and second containers are substantially identical.

3. A dispenser as claimed in claim 1, wherein the connection means are integrally formed with the containers.

4. A dispenser as claimed in claim 1, wherein the connection means are asymmetrical but complementary about an axis along one side of the container.

5. A dispenser for paper wipes and the like comprising:

a first container which is adapted to hold a stack of wipes, the first container having an a aperture in one face providing an opening through which wipes may be dispensed; and a second container for receiving used or soiled wipes, the second container having an aperture in one face providing an opening through which wipes may be passed and a detachable liner within the container for receiving used or soiled wipers, the liner being water and/or solvent resistant, wherein a portion of each of the first and of the second containers being movable between a closed position and a released position in which the first container may be filled or emptied or in which the second container may be emptied, and wherein complementary connection means are provided on the first and second containers to enable the two containers to be releasably joined together.

6. A dispenser as claimed in claim 5, wherein means are provided to indicate the quantity of unused wipes present in the first container.

7. A dispenser as claimed in claim 6, wherein the indicating means comprise a window.

8. A dispenser as claimed in claim 5, wherein the first and second containers are substantially identical.

9. A dispenser as claimed in claim 5, wherein the connection means are integrally formed with the containers.

10. A dispenser as claimed in claim 5, wherein the connection means are asymmetrical but complementary about an axis along one side of the container.

11. A dispenser as claimed in claim 5, wherein means are provided to indicate the quantity of unused wipes present in the first container.

12. A dispenser as claimed in claim 11, wherein the indicating means comprise a window.

* * * * *